US005789865A

United States Patent [19]

Yu et al.

[11] Patent Number: 5,789,865

[45] Date of Patent: Aug. 4, 1998

[54] FLAT-FIELD PLANAR CAVITIES FOR LINEAR ACCELERATORS AND STORAGE RINGS

[75] Inventors: David U. L. Yu, Rancho Palos Verdes, Calif.; Heino Henke, Berlin, Germany

[73] Assignee: Duly Research Inc., Rancho Palos Verdes, Calif.

[21] Appl. No.: 641,612

[22] Filed: May 1, 1996

[51] Int. Cl.[6] ..... H05H 9/00

[52] U.S. Cl. ..... 315/5.39; 315/5.29; 315/5.41

[58] Field of Search ..... 315/5.29, 5.39, 315/5.41

[56] References Cited

U.S. PATENT DOCUMENTS

| | | | |
|---|---|---|---|
| 2,970,242 | 1/1961 | Jepsen | 315/5.39 X |
| 3,119,045 | 1/1964 | Hammersand et al. | 315/5.29 X |
| 3,264,514 | 8/1966 | Udelson | 315/5.29 X |
| 3,784,873 | 1/1974 | Tronc et al. | 315/5.41 |

*Primary Examiner*—Benny T. Lee
*Assistant Examiner*—Justin P. Bettendorf
*Attorney, Agent, or Firm*—Irving Keschner

[57] ABSTRACT

A planar RF accelerating structure for charged particles preferably wherein the accelerating field is independent of the transverse position of the particle beam. In a first embodiment, the RF structure has a "tugboat" design to provide a capacitive loading effect; in a second embodiment, the structure has a "barbell" shape to provide an inductive loading effect. In both configurations, the axial electric field is substantially constant, or assumes a prescribed profile other than the typical half-sine distribution of a conventional rectangular cavity.

2 Claims, 5 Drawing Sheets

FLAT-FIELD PLANAR CAVITIES FOR LINEAR ACCELERATORS AND STORAGE RINGS

BACKGROUND OF THE INVENTION

1. Field of the Invention

The present invention relates to planar RF structures that produce substantially flat electric accelerating fields, the structures being used in linear accelerators or storage rings.

2. Description of the Prior Art

Modern microfabrication techniques based on deep etch x-ray lithography (LIGA) can be used to produce large-aspect-ratio, metallic or dielectric, planar structures suitable for radio frequency (RF) acceleration of charged particle beams. These techniques offer significant advantages over conventional manufacturing methods for RF accelerators operating at high frequencies (>30 GHz).

The LIGA process is particularly suitable for manufacturing miniaturized, planar, asymmetric cavities at high frequency. The main advantages of the LIGA process are fabrication of structures with high aspect ratio, small (submicron) dimensional tolerances, and arbitrary mask shape (cross-section). Other advantages include mass-production with excellent repeatability and precision of up to an entire section of an accelerating structure consisting of a number of cells. It eliminates the need of tedious machining and brazing, for example, of individual disks and cups in conventional disk-loaded structures for electron linear accelerators. Also, planar input/output couplers for the accelerating structure can be easily machined in the same process with the cavities. The fabrication technique should substantially reduce the manufacturing cost of such accelerating structures.

The LIGA process can be used for fabricating high precision and high aspect-ratio, planar structures in the millimeter size range.

One version of LIGA employs very thick (200 micrometers to about 1 cm) photoresist layers, known as PMMA (polymethylmetacrylate, a positive-tone electron-sensitive resist), which are exposed with synchrotron radiation through a suitable mask to produce two-dimensionally defined photoresist patterns. The photoresist-free regions of the substrate can then be filled with electroplated metals which conform to the photoresist geometry. The resulting components are either fully unsupported metal structures or locally attached to the substrate.

It should be noted that planar RF structures, including planar accelerating cavities, can be also fabricated by conventional machining techniques for operating frequencies less than 35 Ghz.

In conventional electron linear accelerators, cylindrical structures are used. These structures are designed for frequencies typically from L band to X band (1 to 14 GHz). Extension to higher frequencies (short wavelength of millimeter or sub-millimeter) of cylindrical structures by conventional machining process is not only expensive and technically difficult, but the machining and brazing are beyond the limits of their capability and tolerances for structures designed for high frequencies, typically frequencies greater than 35 GHz.

Although planar accelerating structures have recently been proposed, the configurations generally produce electric fields which are dependent on the transverse position of the electron beam. The dependence is unacceptable when used to accelerate charged particles because it causes the beam to debunch and to break up.

What is desired is to provide a planar accelerating structure which is configured to provide an accelerating field which is uniform over the domain through which the charged particle beam traverses.

SUMMARY OF THE PRESENT INVENTION

The present invention provides a planar RF accelerating structure, for use in linear accelerators or storage rings of charged particles (such as electrons, protons or heavy ions), wherein the accelerating field is independent of the transverse position, at least over a certain fraction of the aperture area through which the charged particle beam traverses. In a first embodiment, the RF structure has a "tugboat" design to provide a capacitive loading effect; in a second embodiment, the structure has a "barbell" shape to provide an inductive loading effect. The capacitive loading design is preferred for the LIGA manufacturing process since it is compatible with a simpler lithography x-ray fabrication process as it allows for an equal depth of the half structure. In both configurations, the axial electric field is substantially constant, or assumes a prescribed profile other than the typical half-sine distribution of a conventional rectangular cavity.

The present invention thus provides a planar accelerating RF structure for charged particles which can be fabricated utilizing x-ray lithography techniques or conventional machinery techniques, the structure being adapted, for example, for use in linear accelerators or storage rings, wherein the accelerating field produced is substantially independent of the transverse position of the beam. The planar accelerating structure of the present invention offers significant design and fabrication advantages in high-frequency linear accelerators for a broad range of industrial, medical and research applications, for example as injectors for free electron lasers or synchrotron radiation rings, in material processing apparatus or in linear colliders.

DESCRIPTION OF THE DRAWING

For a better understanding of the invention as well as other objects and further features thereof, reference is made to the following description which is to be read in conjunction with the accompanying drawings herein:

FIG. 1(*b*) illustrates the top half structure of a prior art planar rectangular accelerating structure;

DESCRIPTION OF THE INVENTION

Figure 1A:
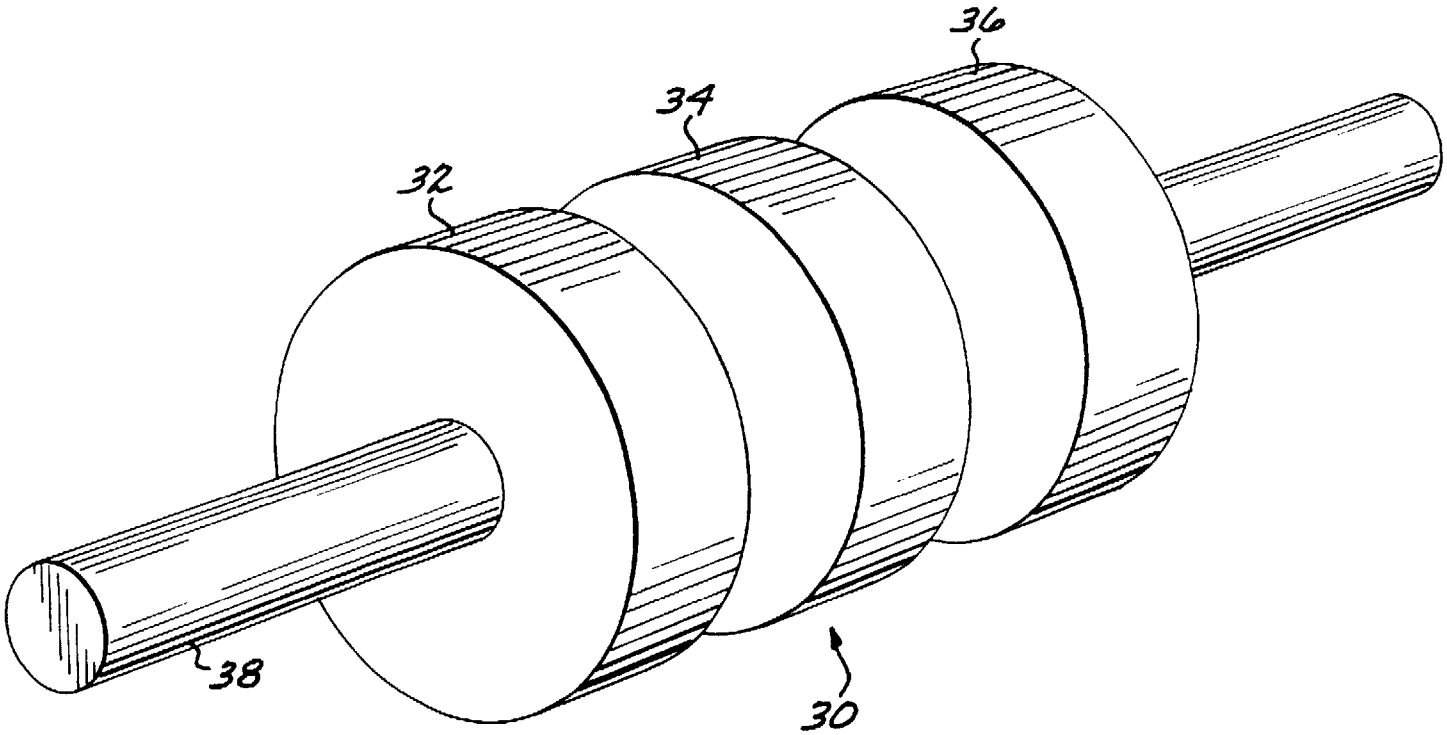
FIG. 1(a) PRIOR ART
Figure 1(*a*) illustrates a conventional cylindrical travelling wave electron linear accelerator, three cells being illustrated.
Figure 1B:
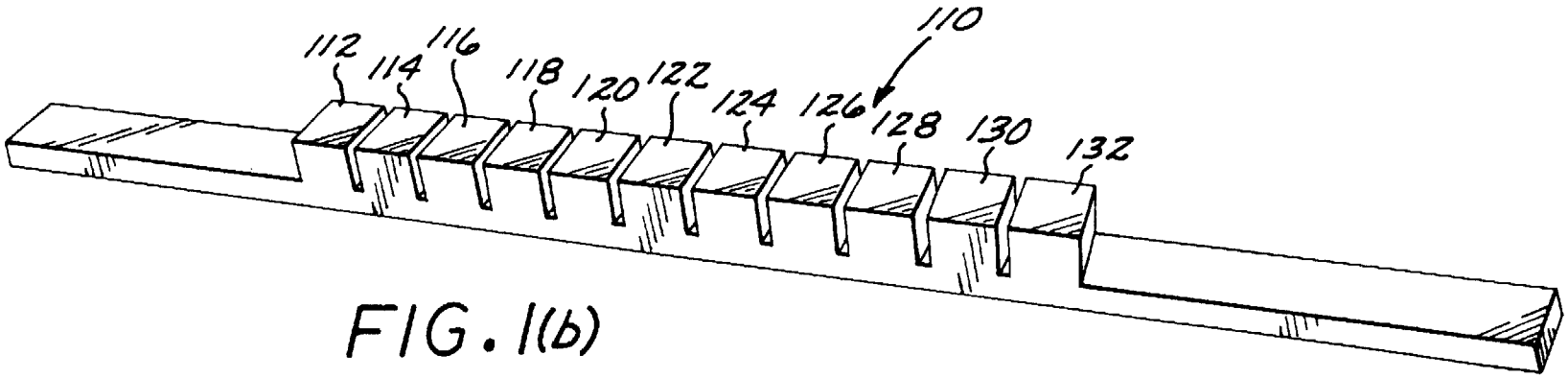

FIG. 1(*a*) illustrates a group of three cells 30 used in a conventional cylindrical travelling wave electron linear accelerator, each cell comprising a cylindrical disk shaped member 32, 34 and 36 having a hollow interior (typically 20–100 of these cells form a section of the accelerator, the electrons being introduced through center member 38.

FIG. 1(*b*) is illustrative of the top half of a prior art planar accelerating structure 110 using rectangular cells. Eleven rectangular cells 112, 114, . . . and 134 are illustrated although typically more than twenty such cells are utilized.

Figure 2B:
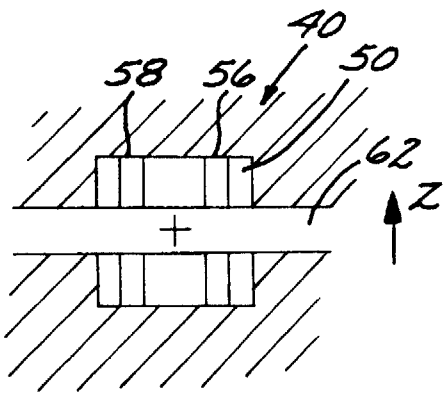
FIGS. 2(*a*), 2(*b*) and 3(*a*), 3(*b*) schematically illustrate two versions of planar RF structures for use in linear electron accelerators in accordance with the teachings of the present invention.
Figure 2A:
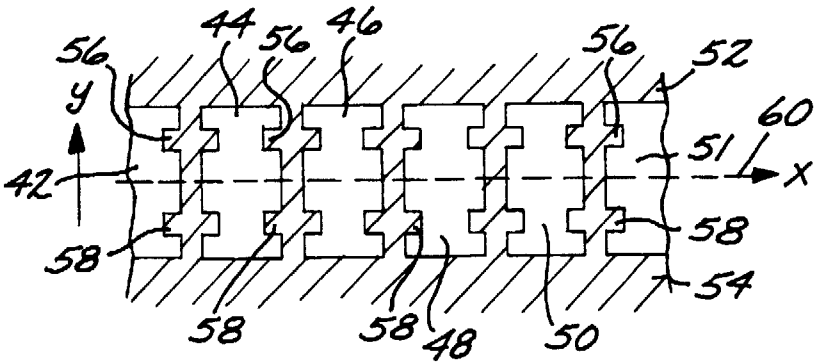

Referring now to FIG. 2, a flat-field planar high-frequency accelerating structure "tugboat" design 40 is illustrated. FIG. 2(*a*) is the plane, or top, view of the structure and FIG. 2(*b*) is the side view, and shows two partial and four complete cells 42, 44, 46, 48, 50 and 51 of the structure. Each cell of the structure (denoted a "tugboat" structure) has a uniform height (Z direction), a first width (x direction) and a pair of rectangularly (although shown as a rectangular shape, the indentation may be round or other shape) shaped indentations 56 and 58 of a second width (x direction). In addition the horizontal width (y direction) can also vary from cell to cell. Each cavity and the hollow space between its top and bottom halves, is surrounded by metal or dielectric material. Unlike cylindrical structures which will encounter increasing fabrication difficulties using conventional machining and brazing methods at high frequencies due to the diminishing physical size, an advantage of the planar structure in the present invention is that at high frequencies they can be manufactured with currently available microfabrication methods. Such microfabrication methods include, for example, the LIGA method using deep etch x-ray lithography, and the wire EDM (electro discharge machining) method. These microfabrication methods are not part of the present invention. The electron beam 60 is directed through channel 62 between the upper and lower portions of structure 40 as illustrated, extending in the axial direction of channel 62. The cell structure is hollow (the hollow part are the cells; the slashed parts are supporting structure). A bunched electron beam is accelerated when it passes near the center of the channel, or cavity, 62 in which an axial RF electric field is established, with the accelerating phase of the electric field synchronized with the arrival time of an electron bunch.

The metal material used in the planar accelerating structure may comprise copper or steel, for example, and the dielectric material may comprise ceramics or sapphire, for example.

Typical dimensions of the structure depends on the RF frequency of the electric field and the bunched electron beam, each dimension being inversely proportional to the operating frequency. The structure dimensions are smaller than the characteristic wavelength (typically about ⅓ or ¼).

Typical separation distances, or beam pipe height, between the two halves of the planar accelerating structure (i.e., width of channel 62) are as follows:

| Frequency | Distance |
|---|---|
| 3 GHz | 3 centimeters |
| 10 GHz | 1 centimeter |
| 30 GHz | 3 millimeters |
| 100 GHz | 1 millimeter |
| 300 GHz | 300 microns |

As noted hereinabove, X-ray lithography creates the flat planar surface structures evidenced in the structures described hereinabove with reference to FIG. 2 and as will be described hereinafter with reference to FIG. 3. The structure provides a substantially constant electric field in the direction of electric accelerations (the x-axis direction).

Figure 3A:
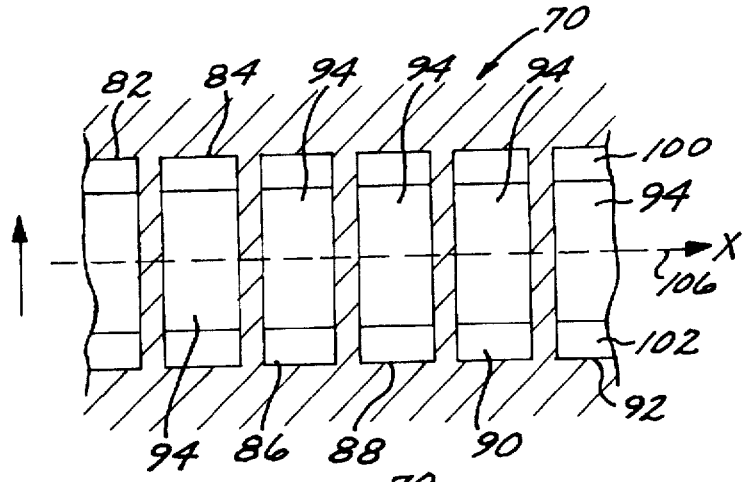
Figure 3B:
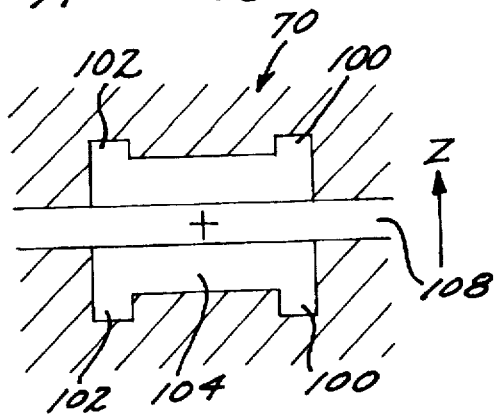

Referring now to FIG. 3, a flat-field planar high-frequency accelerating structure "barbell" design 70 is illustrated. FIG. 3(*a*) is the plane, or top view of the structure (FIG. 3(*b*) is the side view) and shows two partial and four complete cells 82, 84, 86, 88, 90 and 92 of the structure, each cell of the structure, denoted a "barbell" structure, comprising empty, or hollow, area 94 having extended end portions 100 and 102 and a central portion 104. The electron beam 106 is directed through a channel 108 between the upper and lower portions of structure 70 as illustrated.

Figure 4:
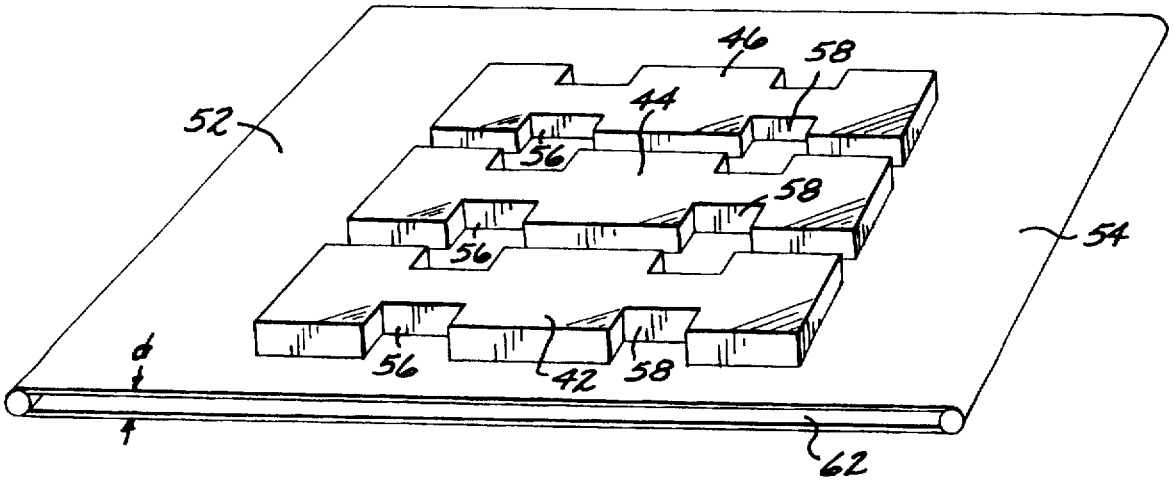
FIG. 4 is a perspective view of the top half of a planar accelerating structure "tugboat" design, three cells being illustrated, in accordance with the teachings of the present invention.

FIG. 4 is a perspective view illustrating the top half of the "tugboat" planar high-frequency structure of FIG. 2 (only three of the cells illustrated). The bottom half is separated from the top half by a distance equal to the beam pipe height. The bottom half portion, although not illustrated, is a mirror image of the structure shown in FIG. 4. The separation distance between the top and bottom halves of structure and their alignment are precisely controlled by mechanical spacers positioned in slots spaced away from the cavities so that the accelerator fields are not effected.

Figure 5:
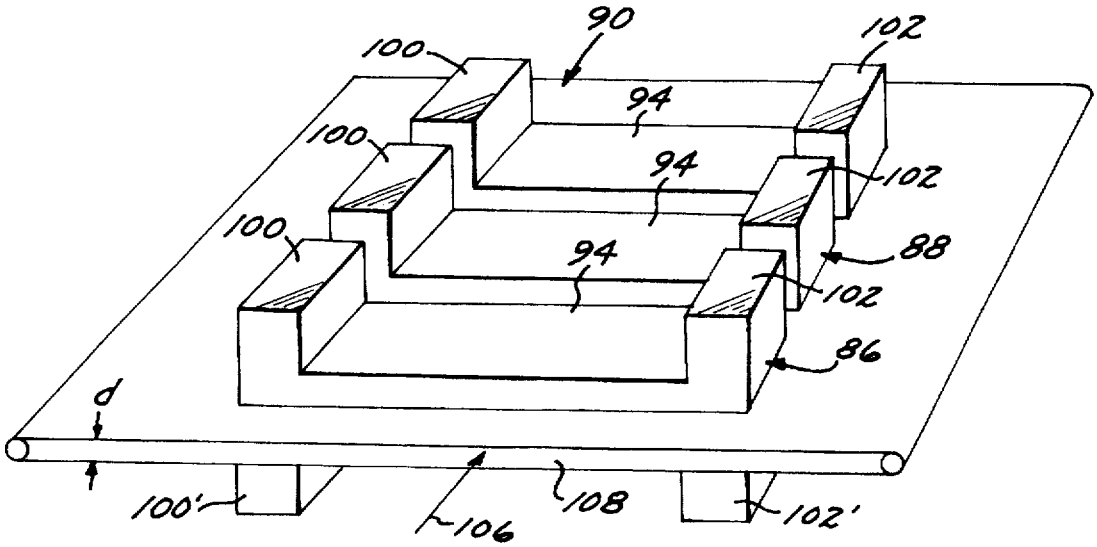
FIG. 5 is a perspective view of a planar accelerating structure "barbell" design, three cells being illustrated, in accordance with the teachings of the present invention.

FIG. 5 is perspective view illustrating three cells of the "barbell" type structure shown in FIG. 3. As set forth hereinabove, towers 100 and 102 of a first height (z direction) are formed at the end of the horizontally, flat structure 94 of a second, or lesser, height. In addition, the horizontal width (y dimension) can vary from cell to cell. The electrons pass through space portion 108. Note, that the structures illustrated by the primed numbers are the mirror image of the structure represented by the unprimed numbers, the two structures being separated by space portion 108. It should be noted that the upper and lower halves of cavities illustrated in FIGS. 2 and 3 are separated by a distance equal to the height of the beam pipe by means of precisely fabricated spacers inserted into grooves on the walls of the side openings. Electrons pass through the beam pipe longitudinally. The interaction of the moving electrons with the varying axial electric field present in the cavities and with external focusing field (not subject of the present invention) determines the motion of the electrons through the beam pipe.

Figure 6A:
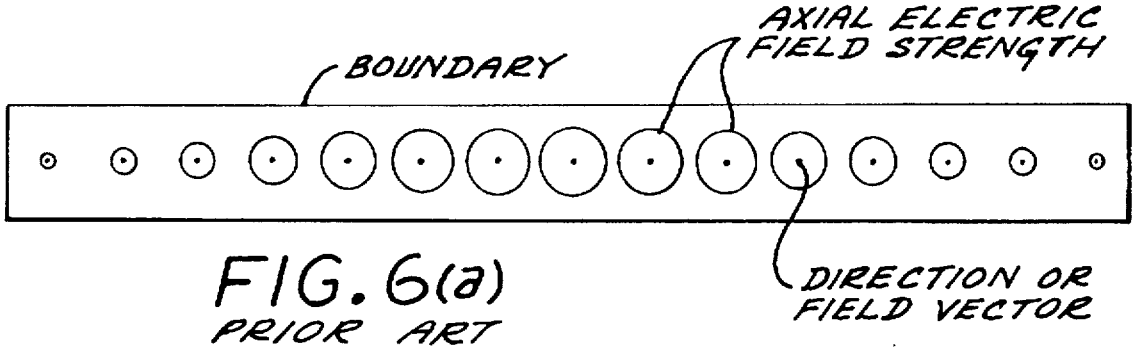
FIG. 6(a) PRIOR ART
FIG. 6(*a*) represents the electrical fields generated by a conventional rectangularly shaped planar accelerating structure and FIG. 6(*b*) represents the electric field generated by the "barbell" planar accelerating structure fabricated in accordance with the teachings of the present invention.
Figure 6B:
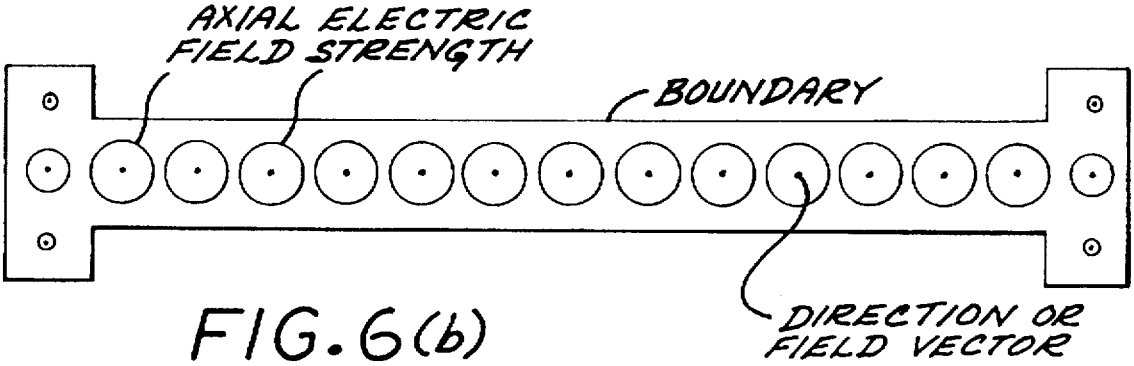

FIG. 6(*a*) illustrates the electric field distribution and magnitude for a prior art rectangular planar accelerating structure (the direction of the field is in a direction perpendicular to the plane of the paper; the magnitude corresponds to the field strength). FIG. 6(*b*) illustrates the electric field distribution and magnitude from the "barbell" planar accelerating structure shown in FIG. 5. The outer lines of FIG. 6(*a*) and 6(*b*) represent boundaries of the structure within which materials other electromagnetic fields are absent. The outline of FIG. 6(*a*) represents a simpler rectangular cavity. The outline of FIG. 6(*b*) represents a barrel cavity. The circles within the cavities are representative of the axial electric field. The size of the circle indicates the relative strength of the field. The dot inside the circle indicates the direction of the field vector (pointing into or out of the plane of the paper). FIG. 6(*a*) shows that for a simple rectangular cavity, the field strength is the highest in the middle, and is not uniform across the width of the cavity. FIG. 6(*b*) shows that for a barbell cavity the field strength is uniform across a major part of the cavity (except at the bell ends). In essence, the "barbell" design provides a substantially uniform electric field along the transverse direction of the path of the electron beam.

Figure 7A:
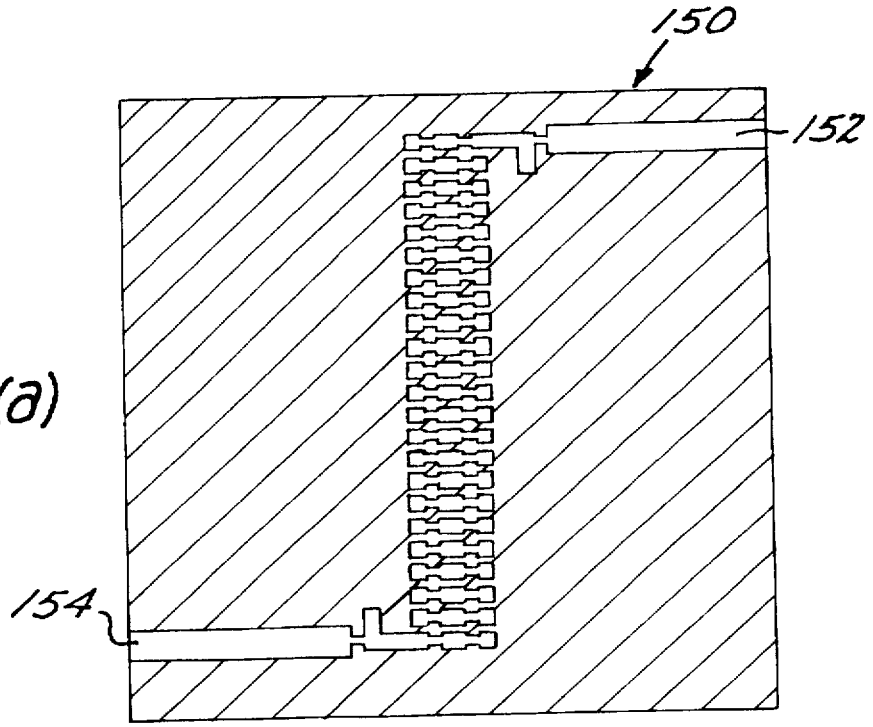
FIG. 7(*a*) is an AUTOCAD design of an accelerator "tugboat" section including input and output couplers and FIG. 7(*b*) is the positive image of the structure shown in FIG. 7(*a*).
Figure 7B:
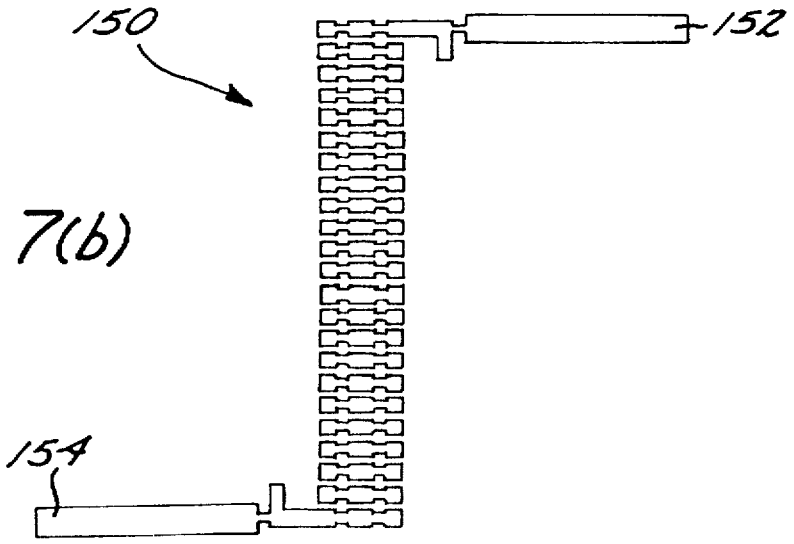

FIG. 7(*a*) is a computerized design (using AUTOCAD) of an accelerator section (top view) 150 consisting of twenty three planar accelerating cells of the "tugboat" design. Also shown is the input waveguide 152 and the output waveguide 154. The RF fills the structure through input waveguide 152, the remaining RF exiting through output waveguide 154.

FIG. 7(*b*) is the positive image of the structure shown in FIG. 7(*a*).

While the embodiment has been described with a reference to its preferred embodiment, it will be understood by those skilled in the art that various changes may be made and equivalents may be substituted for elements thereof without departing from the true spirit and scope of the invention. For example, a "muffin-tin" structure, similar to the illustration of the "tug boat" structure shown in FIG. 4, can be adapted to the "barbell" structure illustrated in FIG. 5. An electron linear accelerator, for example, can be substituted by a RF linear accelerator of any charged particles such as protons or heavy ions. Instead of being used in linear accelerators, planar accelerating cavities can also be used as RF cavities in storage rings. In addition, modifications may be made to adapt a particular situation or material to the teachings of the invention without departing from its essential teachings.

What is claimed is:

1. A planar cavity for sustaining substantially uniform axial electric fields independent of the transverse position of a charged particle beam passing through a channel in said cavity comprising:

a first structure comprising a plurality of planar rectangular shaped cells, each cell having a hollow area surrounded by a structure, each hollow area comprising the same height but portions of the structure having different widths along an axis perpendicular to the direction of said charged particle beam; and a second structure, an exact mirror image of said first structure, said first structure separated from said second structure by a channel through which the charged particle beam reverses, said first and second structures sustaining substantially uniform electric fields independent of the transverse position of said beam within said channel.

2. A planar cavity for sustaining substantially uniform axial electric fields independent of the transverse position of a charged particle beam passing through a channel in said cavity comprising:

a first structure comprising a plurality of planar rectangular shaped cells, each cell having a hollow area surrounded by a metal structure, each hollow area having end portions with a first height along an axis perpendicular to the direction of said particle beam and a portion with a second height extending along said axis, said first height being greater than said second height; and a second structure, an exact mirror image of said first structure, said first structure being separated from said second structure by a channel through which the charged particle beam transverses, said first and second structures sustaining substantially uniform axial electric fields independent of the position of said charged particle beam within said channel.

* * * * *